US005771649A

United States Patent [19]

Zweig

[11] Patent Number: 5,771,649

[45] Date of Patent: Jun. 30, 1998

[54] CONCRETE MONOCOQUE BUILDING CONSTRUCTION

[75] Inventor: Peter J. Zweig, Houston, Tex.

[73] Assignee: Monotech International, Inc., Houston, Tex.

[21] Appl. No.: 570,754

[22] Filed: Dec. 12, 1995

[51] Int. Cl.[6] ..... E04B 2/02

[52] U.S. Cl. ..... 52/405.1; 52/233; 52/286; 52/309.12; 52/309.14; 52/309.17; 52/405.3; 52/405.4; 52/741.41; 52/745.05

[58] Field of Search ..... 52/233, 309.1, 52/309.12, 309.17, 286, 405.1, 404.4, 405.4, 741.41, 405.3, 309.14, 745.05; 264/31, 309

[56] References Cited

U.S. PATENT DOCUMENTS

| | | | |
|---|---|---|---|
| 2,315,895 | 4/1943 | Crom | 264/309 X |
| 2,324,554 | 7/1943 | Billner . | |
| 2,335,300 | 11/1943 | Neff . | |
| 3,225,413 | 12/1965 | Bird et al. . | |
| 3,255,562 | 6/1966 | Altschuler . | |
| 3,410,044 | 11/1968 | Moog . | |
| 3,552,076 | 1/1971 | Gregori . | |
| 3,619,432 | 11/1971 | Harrington . | |
| 3,653,170 | 4/1972 | Sheckler . | |
| 3,676,973 | 7/1972 | Kellert | 52/741.41 X |
| 3,782,049 | 1/1974 | Sachs . | |
| 3,800,015 | 3/1974 | Sachs . | |
| 4,002,707 | 1/1977 | Oram . | |
| 4,041,671 | 8/1977 | Nicholson . | |
| 4,067,164 | 1/1978 | McMillan | 52/309.12 |
| 4,069,629 | 1/1978 | Piazza . | |
| 4,080,767 | 3/1978 | Wilhelm | 52/741.41 X |
| 4,094,110 | 6/1978 | Dickens et al. | 52/741.41 X |
| 4,128,975 | 12/1978 | Abate . | |
| 4,138,833 | 2/1979 | Townend . | |
| 4,170,093 | 10/1979 | Cappellini et al. . | |
| 4,249,354 | 2/1981 | Wynn | 52/309.12 X |
| 4,342,180 | 8/1982 | Gibson et al. | 52/309.12 X |
| 4,365,455 | 12/1982 | Braine . | |
| 4,439,967 | 4/1984 | Dielenberg . | |
| 4,510,724 | 4/1985 | Magnuson | 52/286 X |
| 4,614,071 | 9/1986 | Sams et al. . | |
| 4,678,157 | 7/1987 | Fondiller . | |
| 4,884,382 | 12/1989 | Horobin . | |
| 4,890,993 | 1/1990 | Wilson . | |
| 4,894,969 | 1/1990 | Horobin . | |
| 5,014,480 | 5/1991 | Guarriello et al. . | |
| 5,024,035 | 6/1991 | Hanson et al. . | |
| 5,086,600 | 2/1992 | Holland et al. . | |
| 5,123,222 | 6/1992 | Gaurriello et al. . | |
| 5,193,931 | 3/1993 | Arato | 52/286 X |
| 5,404,685 | 4/1995 | Collins | 52/309.12 X |

OTHER PUBLICATIONS

Berendsohn, Roy, "Home Improvement Rock Solid," *Popular Mechanics, Home & Shop Journal* (Feb. 1995) 4pp.

The Dow Chemical Company, *Stucco on Styrofoam, Brand Insulation*, 6–page brochure.

Hi–Tech Foam Products, Inc., "Pre–Cast Catalog," 8–page brochure.

*The I.C.E. Block, Super Insulated Concrete Building System*, 5–page brochure.

Insteel Construction Systems, Inc., *Insteel 3–D Panel System*, 2–page brochure.

Insulating Concrete Form Association, *Insulating Concrete Forms . . .* , 4–page brochure.

Portland Cement Association, *Concrete Solutions*, 8–page brochure.

Reddi–Form, Inc., *Reddi–Form, Stay–In–Place Insulated Wall Forming System*, 8–page brochure.

Western Insulfoam, *Insulform, Insulated Concrete Form Wall System*, 4–page brochure.

*Primary Examiner*—Christopher Kent

*Attorney, Agent, or Firm*—Spencer & Frank

[57] ABSTRACT

A technique for forming an insulated monocoque concrete shell house, wherein the house structure is built using foamed plastic interlocking and noninterlocking blocks in a manner similar to that in which a log cabin is built using logs. Once the structure is built, openings can be manually cut with ease into the wall of the structure to accommodate windows and doors. The inner and outer surfaces of the foamed plastic block structure, as well as, part of the foundation adjacent to the walls of the structure are sprayed with concrete forming a concrete monocoque shell house.

38 Claims, 15 Drawing Sheets

CONCRETE MONOCOQUE BUILDING CONSTRUCTION

BACKGROUND OF THE INVENTION

This invention relates to a technique for making a concrete monocoque shell house using foamed plastic interlocking and noninterlocking blocks to form the structure of a house on a concrete foundation which is then sprayed with a layer of concrete to form a monocoque shell house structure.

In many poorer countries, housing is beyond the grasp of most people. To make housing more affordable in those countries, low cost house building techniques are required.

Many lower cost techniques for building homes have been developed. In one technique, a flexible membrane is erected over a framework. One or more layers of foam are then formed on the membrane to stiffen it and provide a substrate for carrying a heavier layer. The layer of foam is then sprayed with concrete to form the structural shell of the building. The problem with this technique is it makes it difficult to do details. For example, to form openings to accommodate windows, the frame structure must be designed and built with such openings, and the flexible membrane must be erected accordingly so as not to block the opening.

Another technique uses stackable plastic blocks, much like cinder blocks, which are hollow in their center and have openings on their edges providing access to their hollow centers. Once stacked forming the building structure, these blocks are filled with concrete which forms the principal structure of the building. With this technique, details are also difficult to do. For example, after the blocks are in place, openings for accommodating windows cannot be formed without rearranging the blocks. Furthermore, special blocks must be used around openings so that when filled with concrete, the concrete does not flow into the opening.

Other techniques use blocks to form the substrate structure of a house to which is applied a fiber mesh. Cement or stucco is then sprayed on the fiber mesh forming a cell structured house. To form details with this technique, such as window openings, the openings must be formed on the substrate, as well as on the fiber mesh.

A common problem with all of these techniques is, that once the underlying structure of the house is formed, the structure can not be easily modified. For example, extra openings for windows cannot be formed without spending excessive amounts of time redesigning and rebuilding the underlying structure. Such modifications can add significantly to the cost of building the house.

Another problem with these techniques, is that they may not provide sufficient insulation. A low cost house is not very desirable, if the costs associated with heating it are excessive.

Accordingly, there is a need for a technique for building low cost housing which allows details (e.g., cutaways and openings) to be easily incorporated with minimal or no increase in the house cost. In addition, the technique must include steps for sufficiently insulating the house for minimizing the energy required to heat it.

SUMMARY OF THE INVENTION

The present invention relates to a low cost technique for forming an insulated monocoque concrete shell house. To form the house, a concrete foundation is formed having a ledge. The ledge spans the periphery of the foundation and defines the outer plan shape of the house. The external walls of the house are built against the ledge.

The house structure is built on the foundation using foamed plastic interlocking and noninterlocking blocks in a fashion similar to that in which logs are used to build a log cabin. The walls of the house are built using blocks selected from a set comprising double lock, single lock, plain, hybrid, double rectangular peg and peg support blocks. Each wall interlocks with its adjacent walls.

The roof of the house is built using foamed plastic blocks which interconnect using a tongue and groove method. The roof is built from blocks selected from the group comprising of angle edge blocks, triangular blocks, curved rectangular and semirectangular blocks, and combinations thereof.

To interface the roof to the walls, interface plates are used selected from the group consisting of the interface-1, interface-2, interface-3 and interface-4 plates. Tie down rods embedded into the foundation may also be used to tie down the interface plates and the blocks forming the walls against the foundation.

Window and door openings can be manually cut with ease into the structure at the site. Electrical and plumbing hardware can also be easily embedded into the blocks through slits cut on the outer surface of the blocks.

The foamed plastic block built structure is then sprayed with concrete on its inner and/or outer surfaces as well as on the foundation adjacent to the walls of the structure, forming a monocoque shell structure. The concrete may also be applied by hand trowel. The concrete contains polymer adhesives to facilitate adhesion to the foamed plastic and the foundation, and also contains chopped fibers to increase the concrete flexural and impact strength as well as toughness, fatigue strength and resistance to cracking. Once set, the concrete forms the monocoque shell house structure, while the foamed plastic, with its excellent insulating characteristics is sandwiched within the concrete, insulating the monocoque structure.

DETAILED DESCRIPTION OF THE PREFERRED EMBODIMENT

This invention relates to a technique for making insulated low cost concrete shell monocoque structure houses. Foamed plastic blocks of different shapes are used to build the structure of the house on a concrete foundation in a fashion similar to that in which logs are used to build a log cabin. The foam plastic blocks could be made from expanded plastic, such as expanded rigid polystyrene plastic which is commonly known as Styrofoam. Once formed, the inner and outer surfaces of the foamed plastic block structure and part of the foundation are sprayed with concrete forming a monocoque concrete shell structure house.

Figure 1:
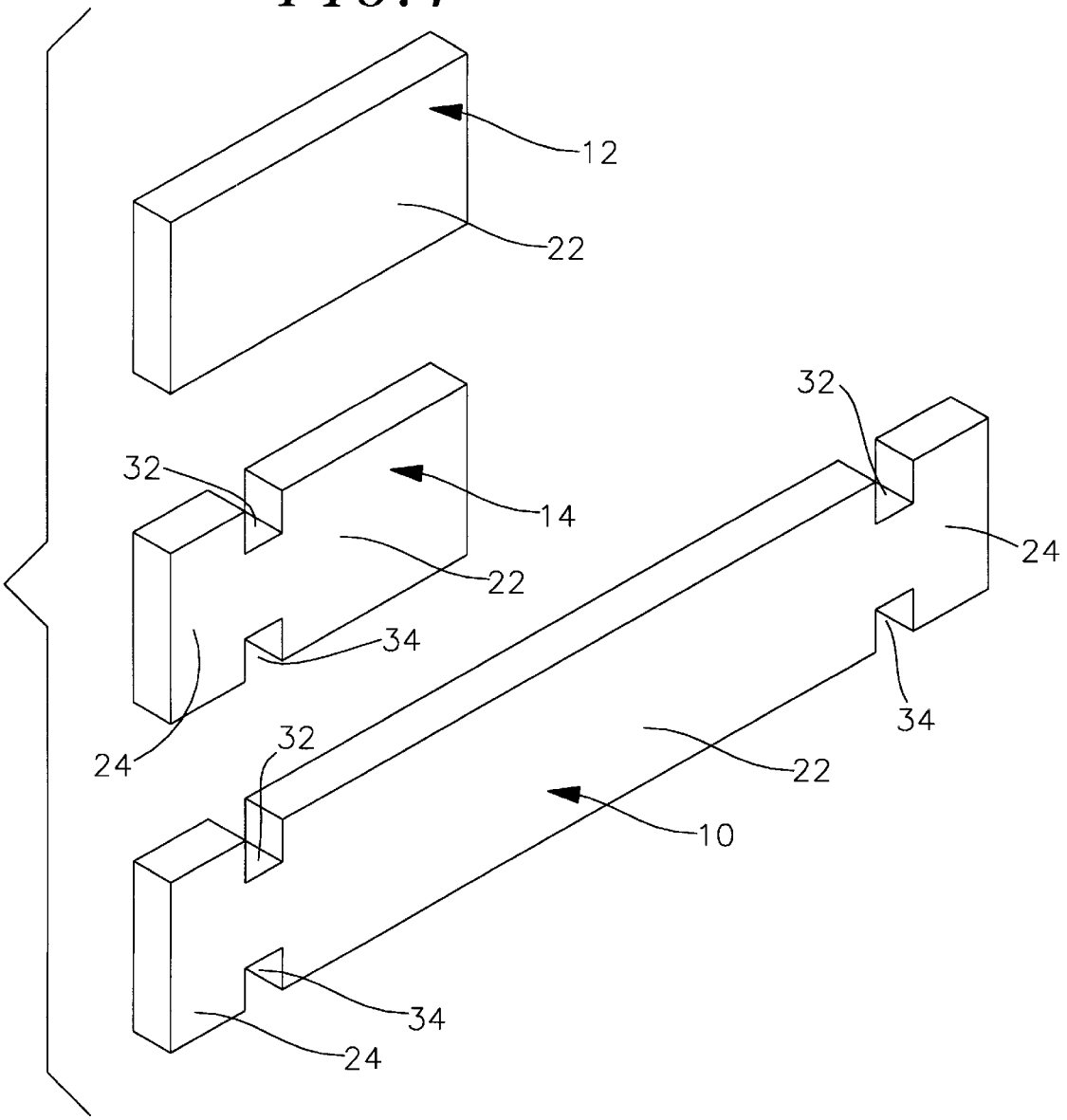
FIG. 1 isometrically depicts the mono-lock set of blocks comprising a plain, a single lock and a double lock block.
Figure 2:
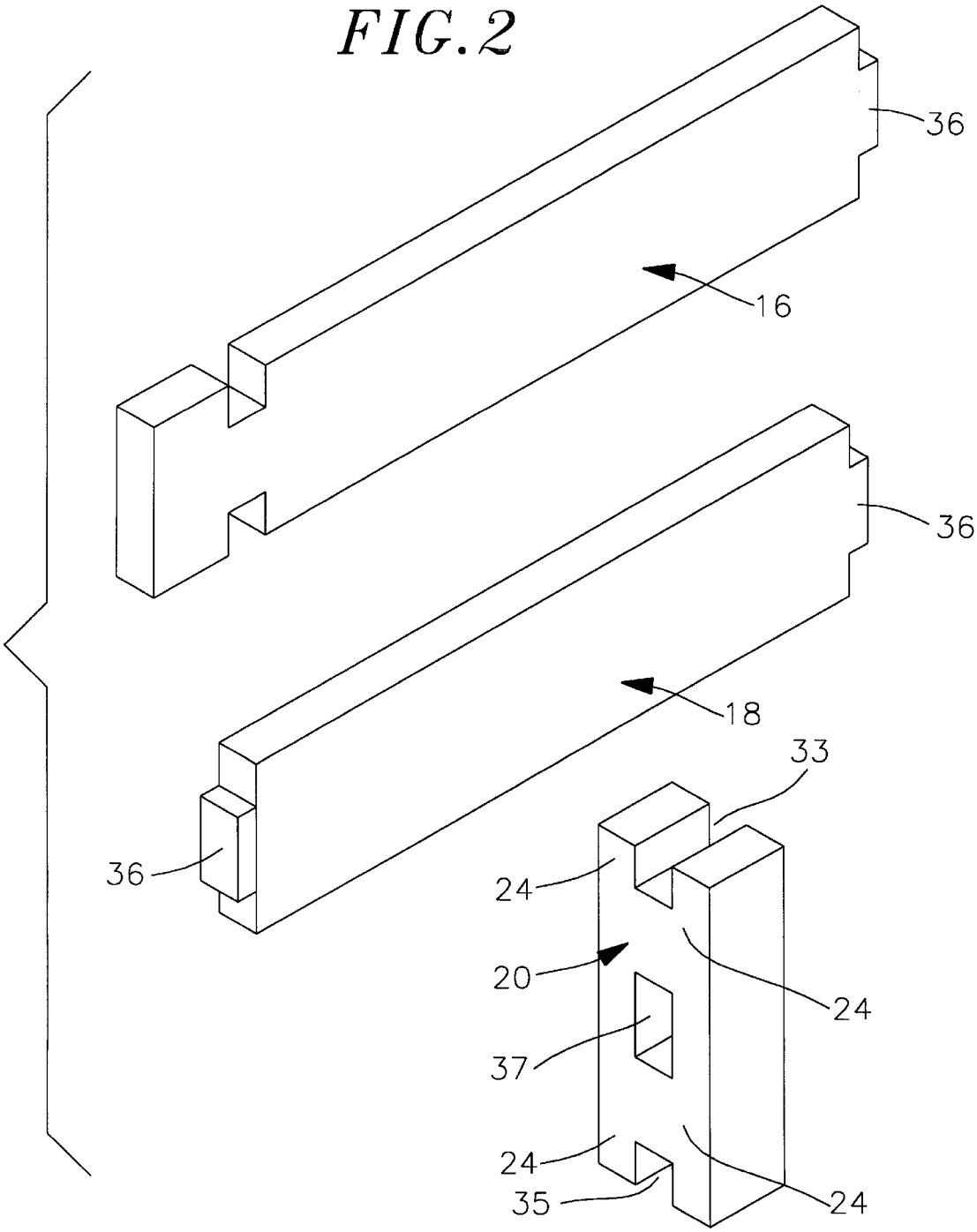
FIG. 2 isometrically depicts the mono-bond set of blocks comprising a hybrid, a double rectangular peg and a peg support block.

The walls are typically formed by using foamed plastic blocks 8 having any of six different shapes. The six shapes of blocks are labelled for descriptive purposes as the double lock 10, the plain 12, the single lock 14, the hybrid 16, the double rectangular peg 18, and the peg support 20 (also referred to as support) blocks (FIGS. 1 and 2). All blocks have the same thickness, for example 2.5 cm. These blocks can be easily manufactured at the site using portable presses. In addition, when necessary they can be manually cut with ease to alter their shape to interface with the other blocks or the foundation. They can easily be patched or fastened with glue, screws or pins. Furthermore, the foamed plastic blocks serve as insulation material.

With the exception of the peg support blocks all blocks have the same height. Typical heights are in the order of 60 cm. The peg support block has a height approximately twice the height of the other blocks. The blocks can have different lengths. The length, height or thickness of the blocks is not important in describing the various embodiments of this invention.

Figure 3:
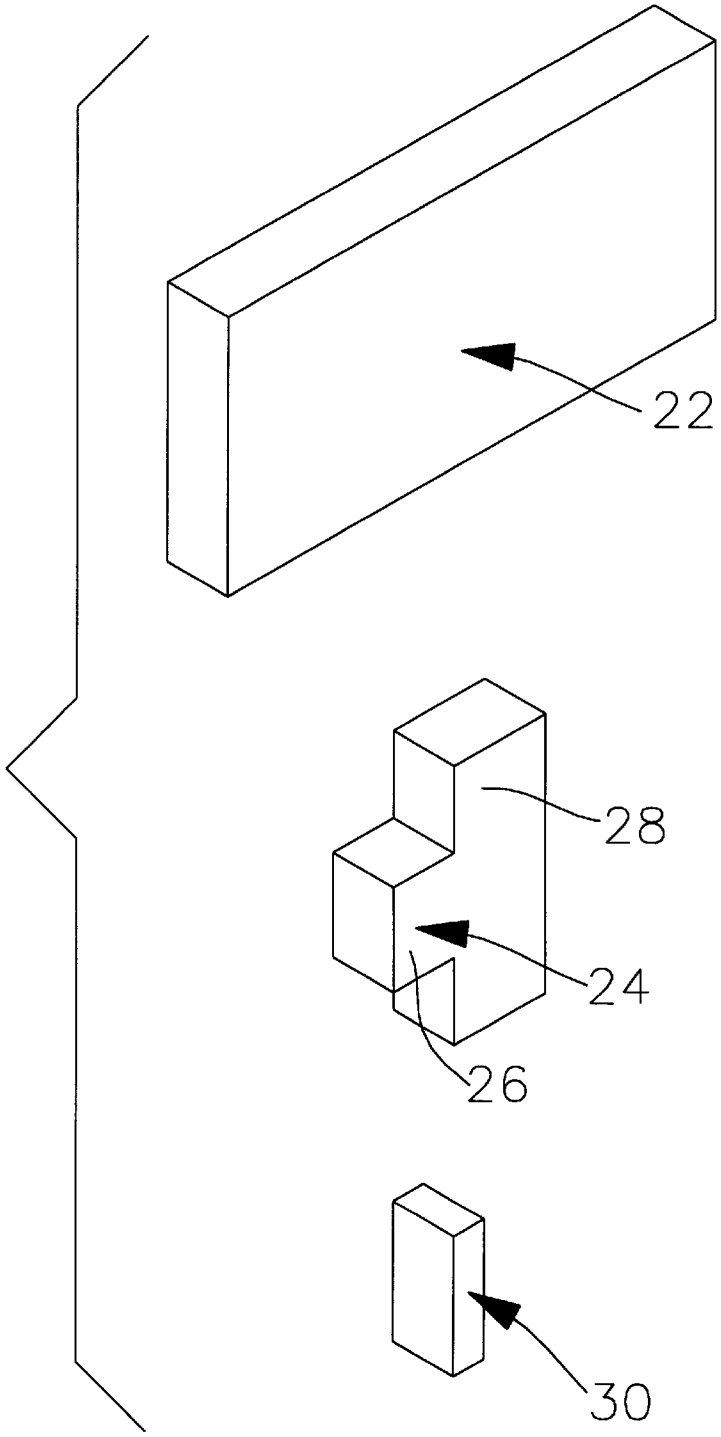
FIG. 3 isometrically depicts the three sections, A, B and C which are used to form a mono-lock or a mono-bond block.

Although the blocks are continuous, they are formed from a combination of any of three distinct shaped sections. For descriptive purposes, the three shaped sections are designated as A section 22, B section 24 and C section 30, respectively (FIG. 3). A section 22, is a rectangle. B section 24, is a sideways "T" wherein the length of the base 26 of the "T" crossbar is equal to or slightly longer than the thickness of the block, and wherein the length of the "T" crossbar 28 is equal to the height of the block. The C section 30, is a rectangle having a height smaller than the height of the A rectangle and a length approximately equal to half its thickness.

The double lock block 10 (FIG. 1) is composed of three sections, an A section with a B section cantilevered from each A section heightwise side. The longitudinal central axes of all three sections are aligned. The interface between the A and each B section forms an upper notch 32 and a lower notch 34. Thus, the double lock block has four notches, two upper and two lower notches. The length of each notch is equal to the length of a B section base leg and, therefore, as discussed above is equal to or slightly longer than the thickness of the block.

Figure 15:
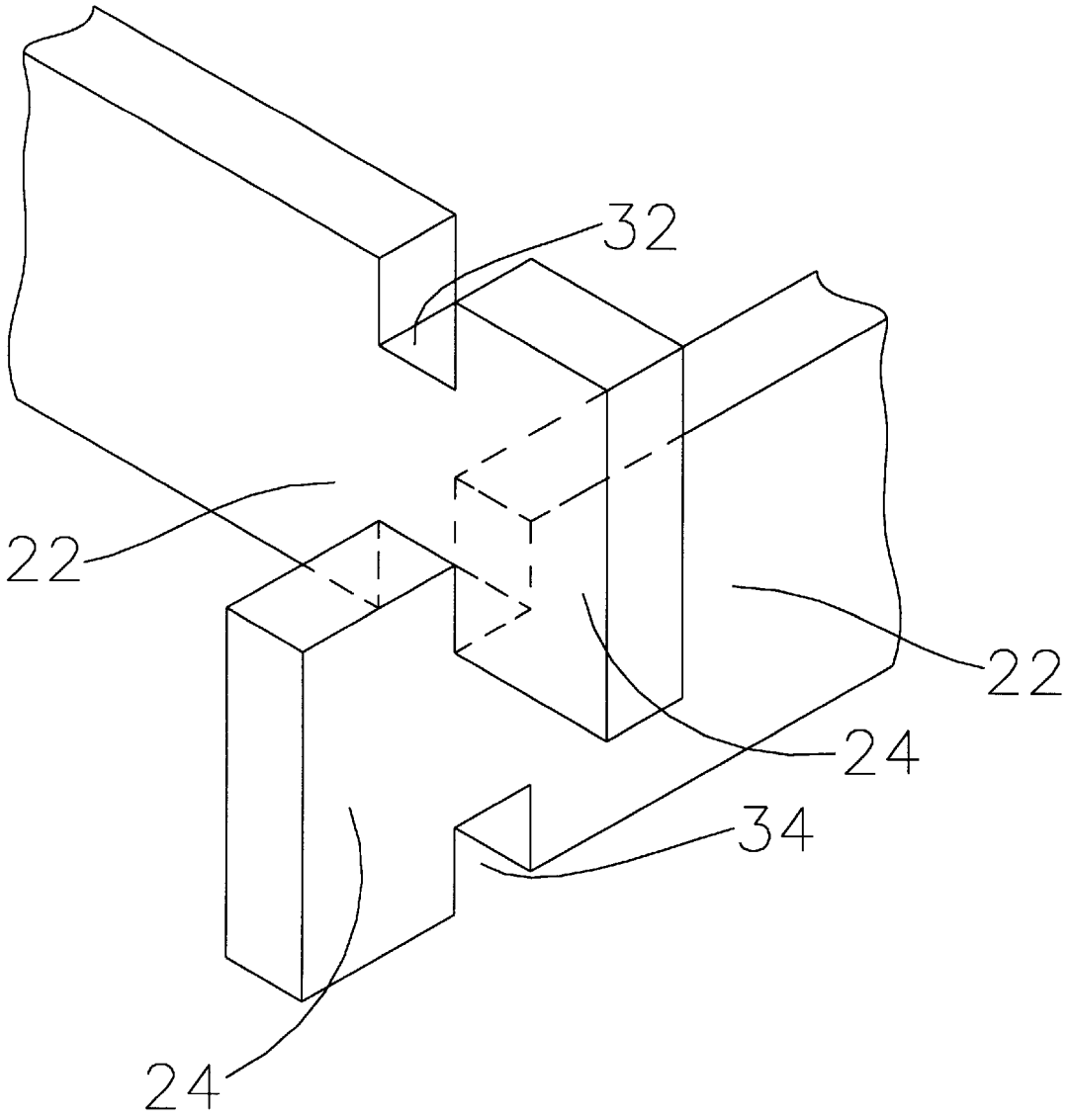
FIG. 15 is an isometric view of two blocks having B sections interlocking with each other.

These notches allow for the interlocking of the blocks. Each block that has a B section can interlock with another block that has a B section. For example, two double lock blocks can interlock with each other. To interlock the blocks, one block is positioned perpendicularly over the other so that a lower notch of the upper block slides over a portion of the B section base leg 26 of the lower block. At the same time, the upper notch of the lower block will slide over a portion of the upper block's B section base leg. When this occurs, the two blocks are interlocked together, as shown in FIG. 15.

The plain block 12 (FIG. 1) is a rectangular shaped block. It is comprised only of an A section. The single lock block 14 (FIG. 1) comprises an A section with a B section cantilevered from an A section heightwise side. In essence, it is like a double lock block but comprising only one B section.

The hybrid block 16 (FIG. 2) is composed of three sections, an A section with a B section and a C section each cantilevered from the A section opposite heightwise sides. All three sections are aligned along their central longitudinal axes. The C section forms a rectangular peg 36 extending beyond the rectangular A section.

The double rectangular peg block 18 (FIG. 2) is comprised of an A section with a C section cantilevered from each A section heightwise side. Again, all sections are aligned along their central longitudinal axes.

The peg support block 20 (FIG. 2) is composed of four B sections. Each B section base leg end is abutted to another section's base leg end forming a block which is symmetrical about its longitudinal (horizontal) central axis and about its vertical central axis. In turn, the block has a notch on its upper end 33, a notch on its lower end 35 and an opening 37 at its center which is shaped to match the cross sectional shape of the rectangular pegs (C sections) of either the hybrid or the double rectangular peg blocks. When two support blocks are positioned directly on top of each other, the lower notch of the upper support block and the upper notch of the lower support block also form an opening matched to the pegs. The peg support block is designed for supporting the rectangular peg portions (C sections) of the hybrid and double rectangular peg blocks (referred herein as the "peg blocks").

To provide support, a support block is placed perpendicularly to a peg block. The peg 36 of the first peg block is inserted into a notch 33, 35 or opening 37 of the support block until the peg block's A section abuts against the support block. When this occurs, the peg penetrates half of the thickness of the support block. A second peg block peg is inserted into the notch or opening of the support peg block from the side opposite the first peg block until the second peg block's A section abuts against the support block and its peg abuts against the first peg block peg. These six shapes of blocks are the blocks of choice for building the walls of a house. Preferably, however, the walls are built using blocks selected from a set comprising only the double lock, plain or single lock blocks or selected from a set comprising only the hybrid, double rectangular peg and peg support blocks. For descriptive purposes, the former set of blocks is referred to as the mono-lock set and the latter set is referred to as the mono-bond set. Accordingly, walls formed with the mono-lock set of blocks are referred to as mono-lock walls, while walls formed with the mono-bond set of blocks are referred to as mono-bond walls.

Figure 4:
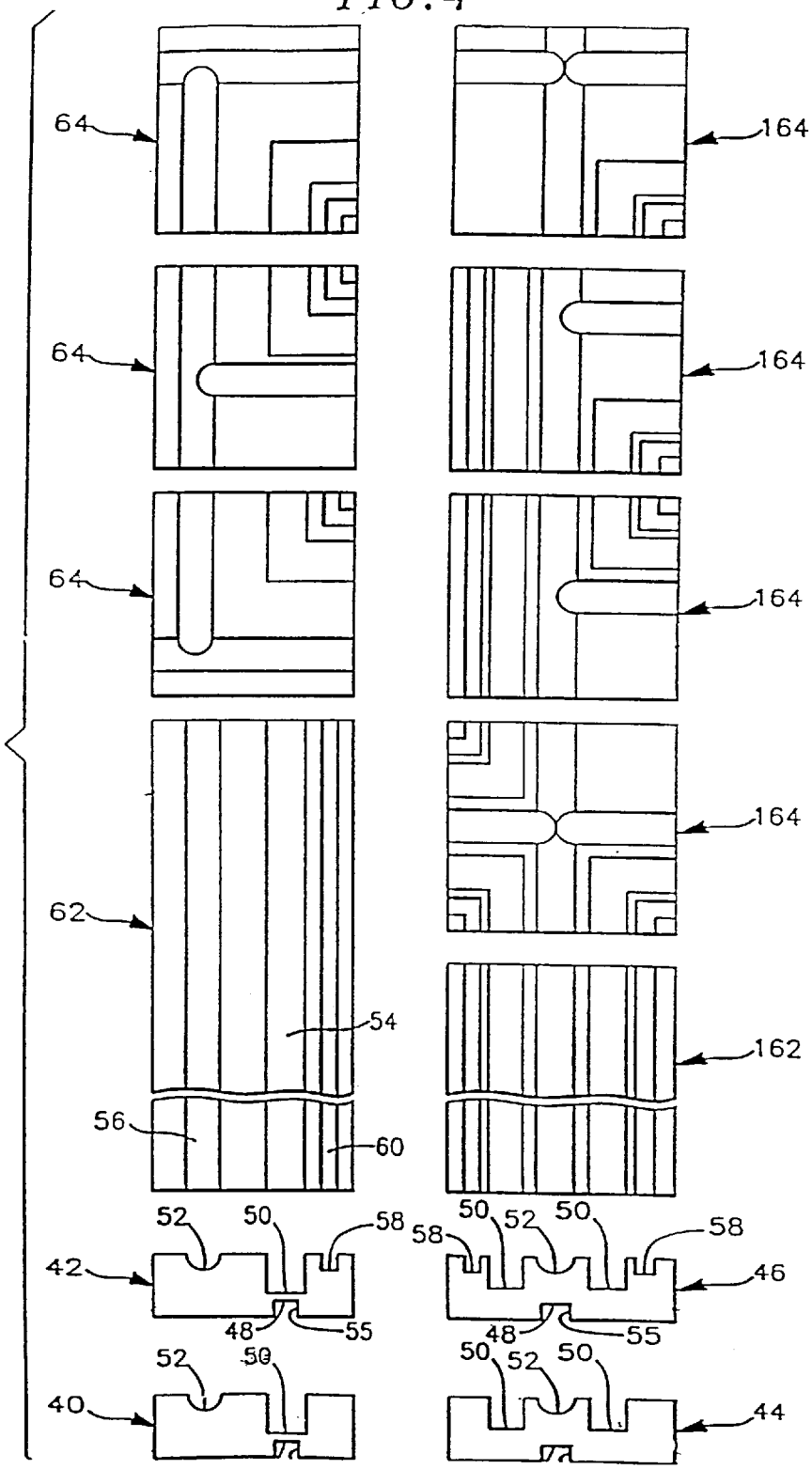
FIG. 4 depicts end views of the interface-1, interface-2, interface-3 and interface-4 plates, as well as, top views of linear and corner interface-2 and interface-4 plates.

Interface plates, preferably made of foamed plastic, are used to provide a means for attaching the roof to the walls. These plates have specialized cross sectional shapes and may have lengths which span the length of a wall. They allow for roof support, as well as, provide water gutters to control rain water flowing down from the roof. These interface plates may have any of four preferred cross sectional shapes designated as interface-1, 40; interface-2, 42; interface-3, 44; or interface-4, 46 (FIG. 4).

All four interface plates have rectangular cross sectional shapes. The interface-1 plate has a lower notch 48 and upper notch 50 aligned about a vertical axis. The upper notch (referred herein as the "roof notch") is designed to engage the roof. The lower notch (referred herein as the "wall notch") is designed to be slid over and engage the wall. Furthermore, a rounded notch 52 on the upper surface serves as the gutter. Along the length of the interface plates, the roof notch forms a roof groove 54, the wall notch forms a wall groove 55 and the gutter notches form the gutter 56.

The interface-2 plate has the same cross section as the interface-1 plate and further includes a smaller notch 58 on its upper surface opposite the gutter notch on the other side of the roof notch. This small notch (referred herein as the "light notch") is designed to form a light groove 60 to accommodate an electric light source such as a fluorescent light bulb.

The interface-3 and interface-4 plates are used in situations where two roof sections must be interfaced with a single wall. The interface-3 plate has a rectangular cross sections with two roof notches 50 on its upper surface symmetrically located about the block central vertical axis. On the upper surface about the central vertical axis is a gutter notch. On the lower surface also about the central vertical axis is the wall notch 48. The interface-4 plate has the same cross section as the interface-3 plate with two additional light notches 58 each located on either side of each roof notch proximate the block edges. In an alternate embodiment, the interface plates do not incorporate gutter notches or gutters.

For descriptive purposes, the interface plates used along the length of the walls are referred to as the linear interface plates 62, 162. To accommodate the corners (wall intersections), the interface plates can have any of the above described cross section on at least three adjacent edges forming grooves along their length, as well as along their width. These interface plates are referred to as the corner interface plates 64, 164.

Figure 5:
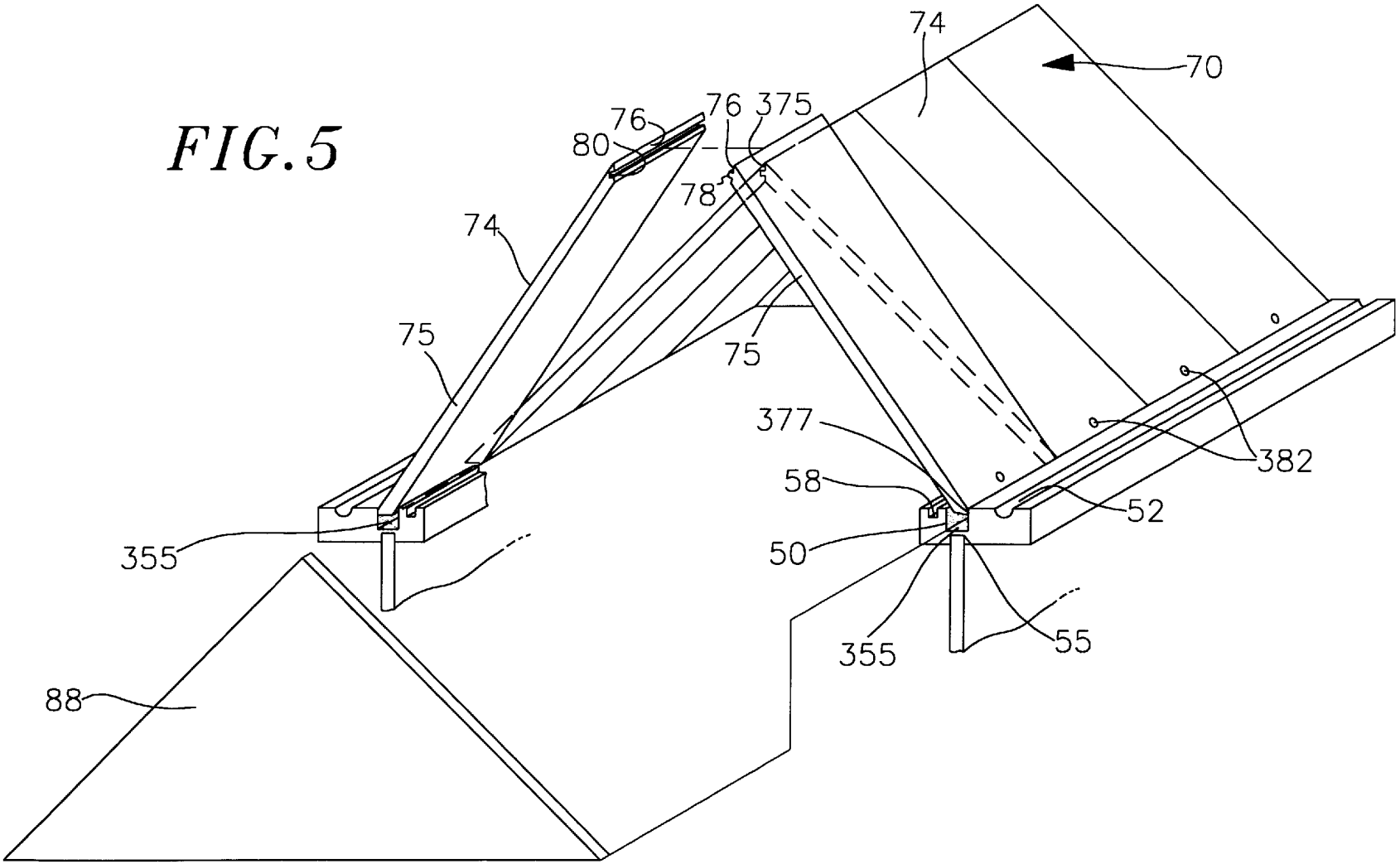
FIG. 5 is an isometric view of an inverted V-shaped roof assembly.
Figure 6:
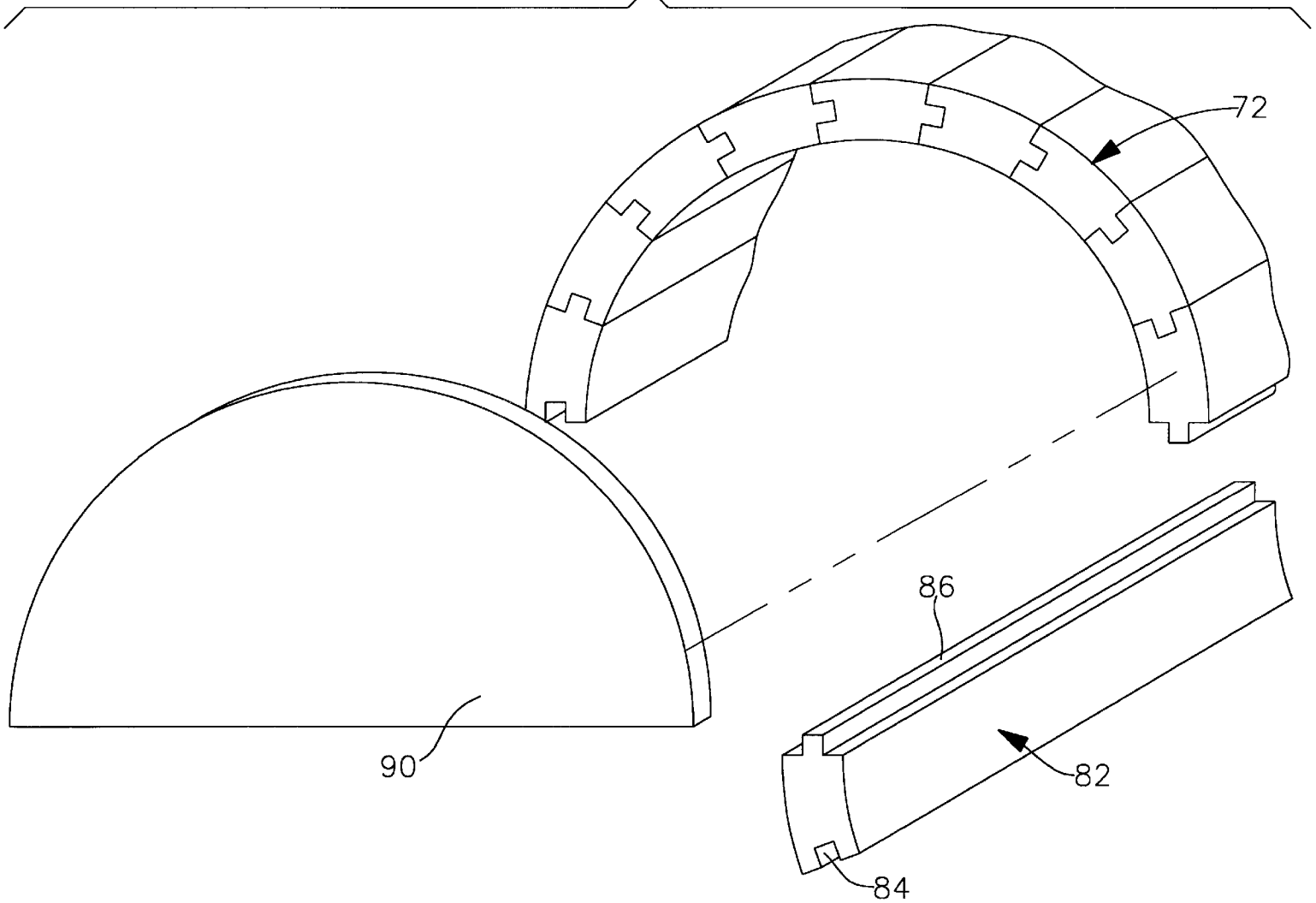
FIG. 6 is an isometric view of a semicircular roof assembly.

The roof sections are preferably either of two shapes, inverted V-shaped 70 (FIG. 5) or semicylindrical shaped 72 (FIG. 6). An inverted V-shaped roof is formed by rectangular shaped blocks 74 having angled edges 76. Each angled edge has either a tongue 78 or a groove 80 such that the tongue of one block's edge can connect with the groove of another block's edge to form the inverted V-shape. A semicylindrical shaped roof is formed by curved rectangular blocks having a groove 84 along one of their longitudinal edges and a tongue 86 on the other such that the tongue of one block can engage the groove of another block allowing multiple curved blocks to be connected to form the semicylindrical roof 72.

In an alternate embodiment, the semicylindrical roof can be formed from a single semicylindrical piece. In another embodiment, the roof may be quarter round rather than half round.

To close the ends of a inverted V-shaped roof, triangular blocks 80 (FIG. 5) may be used. In a similar fashion, semicircular blocks 90 (FIG. 6) may be used to close the ends of a semicylindrical roof. Quarter circular blocks may be used to close the ends of quarter round roofs.

Figure 7:
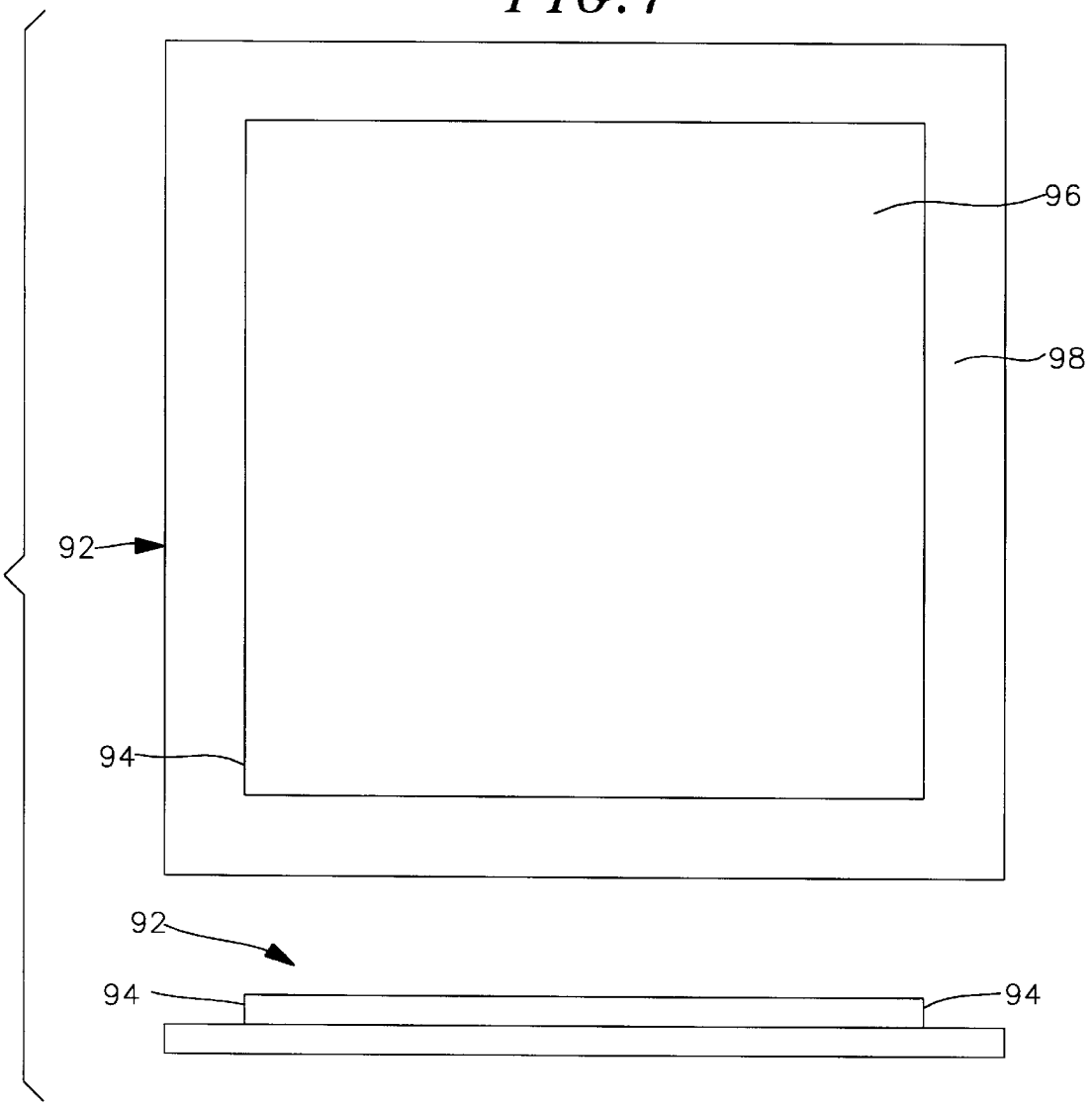
FIG. 7 is a top and an end view of a concrete foundation having a square ledge.

To build the structure of the house using the foamed plastic blocks, a foundation 92 is formed with a ledge 94 proximate its periphery (FIG. 7). In essence, the ledge creates a "step" in the foundation, where the thickness of the foundation is stepped up forming a thicker section 96 bordered by a thinner peripheral section 98 i.e., forming a stepped ledge. The peripheral ledge defines the plan outer shape of the house. In an alternate embodiment, a foundation without a stepped ledge is formed.

Threaded galvanized tie down rods 100 (FIGS. 8A and 8B) are built into the foundation peripheral thinner section at a distance from the ledge approximately equal to half the thickness of the blocks. These threaded rods are built into the foundation at intervals around the foundation perimeter. As the house structure is built using the foamed plastic blocks, holes 107 are drilled vertically (heightwise) through the thickness of the blocks to allow for penetration of the threaded rods.

Various embodiments of the present invention are described herein relating to the building of a square house. However, as it will be obvious to one skilled in the art, the embodiments are applicable to any shape house having perpendicular walls.

Figure 9:
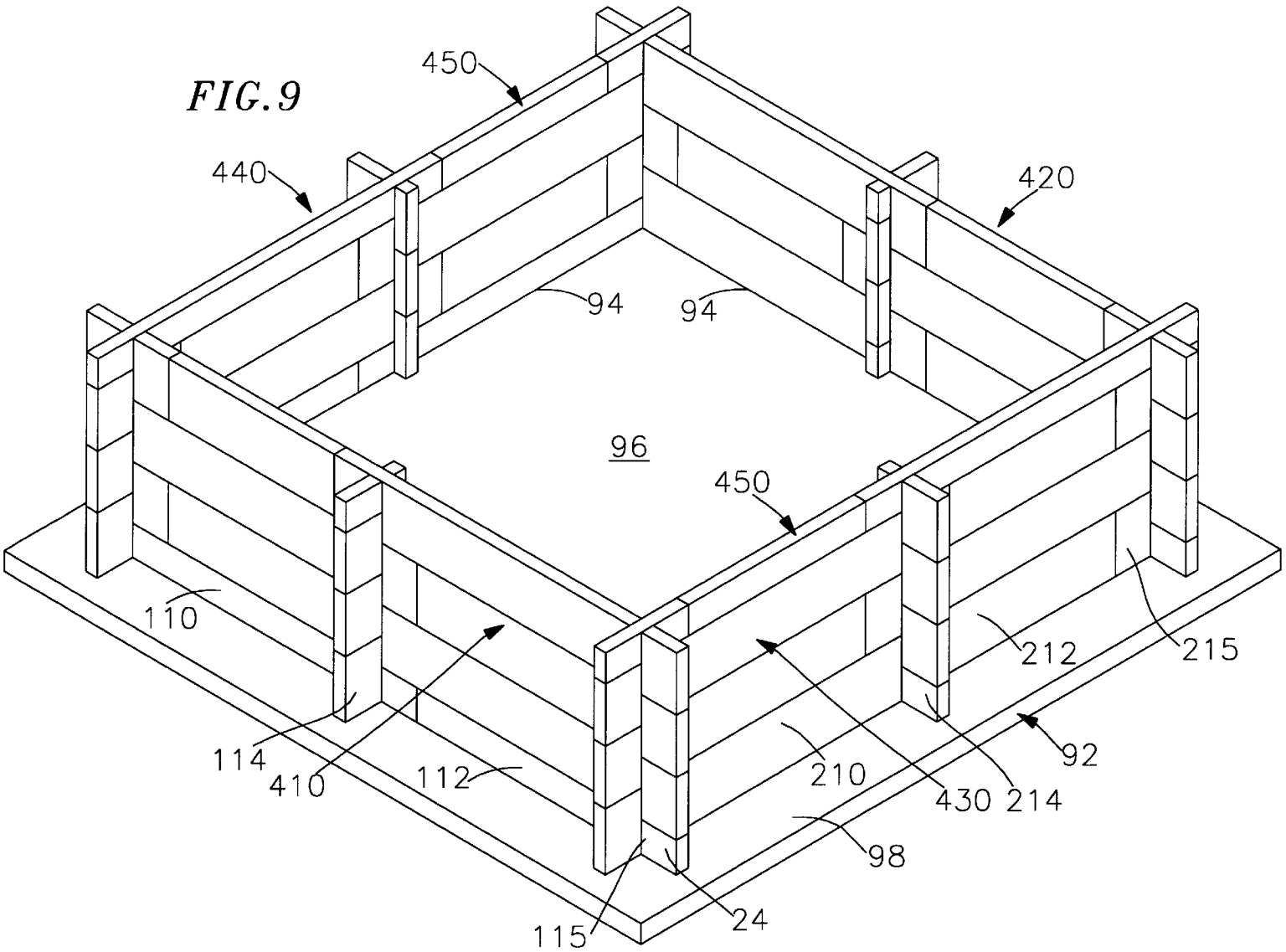
FIG. 9 is an isometric view of the walls of a square house built on a concrete foundation using the mono-lock set of blocks.
Figure 10A:
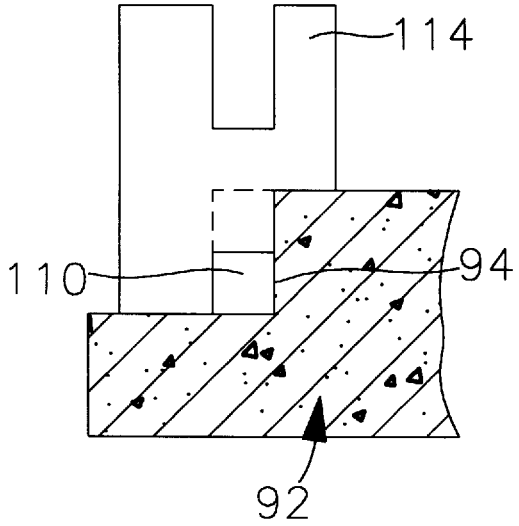
FIG. 10A is an elevation view of a partial single lock block interlocking with a half double lock or plain block forming the base level of a wall which interfaces with the foundation.

To build a mono-lock wall square house, a foundation 92 is first laid with a ledge 94 forming a square (FIG. 9). A double lock block 110 is cut in half along its longitudinal axis. Half of this block having its notches on its upper edge is placed heightwise against the ledge such that one of its B sections protrudes beyond the ledge. Next the nonprotruding B section of the block is perpendicularly engaged by the B section of a full single lock block 114 interlocking the two blocks. In order to accomplish this and to prevent interference with the ledge, the lower half of the "T" crossbar of the B section of the single lock block is cut away (FIG. 10A). When interlocked, the two blocks provide support to each other.

Next, a plain block is cut along its longitudinal central axis. A half plain block 112 is then abutted against the half double lock block and the ledge. Finally, half of a single lock block 115 is abutted against the half plain block and the ledge so that its notch is on its upper edge. The blocks have lengths such that when all three pieces are set against the ledge, the B sections 24 of the double and single lock blocks protrude beyond their respective side the ledge. These three blocks form the base level of the first wall 410. The base level of the second wall 420, which is parallel to the first wall, is formed using the same set of half blocks, but in reverse order.

Figure 10B:
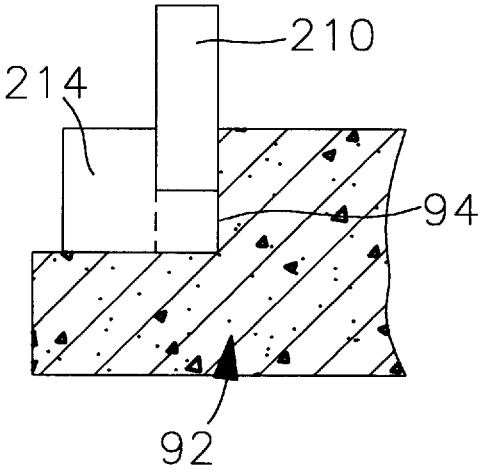
FIG. 10B is an elevation view of a partial single lock block interlocking with a full single lock or double lock block forming the base level of a wall which interfaces with the foundation.

The base of the third wall 430 which is perpendicular to the first and second walls, is built using a full double lock 210, a full plain 212, a full single lock 215 and a half single lock block 214. The first three of these blocks are set against the ledge of the foundation such that the full double lock block of the third wall interlocks with the split single lock block of the first wall and the full single lock block of the third wall interlocks the split double lock end block of the second wall. The half single lock block 214 is positioned perpendicularly and slid under the B section of the double lock block interlocking with the full double lock block (FIG. 10B). The base level of the fourth wall 440, which is parallel to the third wall, is built in the same manner as the third wall but with the reverse sequence of blocks.

Next, full blocks are used to build the next level of the first and second walls but in reverse sequence than their corresponding base level. The same approach is followed with the third and fourth walls. Once, the walls are built to a sufficient height, the last levels 450 of the third and fourth wall will have to be built using half blocks such that the height of all four walls is equal.

The interlocking between the blocks provides lateral support to the walls. Further support is provided by staggering the sequence of the types of blocks used within a wall.

It should be noted that the walls can also be built using a different combination of the mono-lock blocks. For example, each wall level can comprise two longer double lock blocks and two single lock blocks to interlock with the double lock blocks.

Figure 10C:
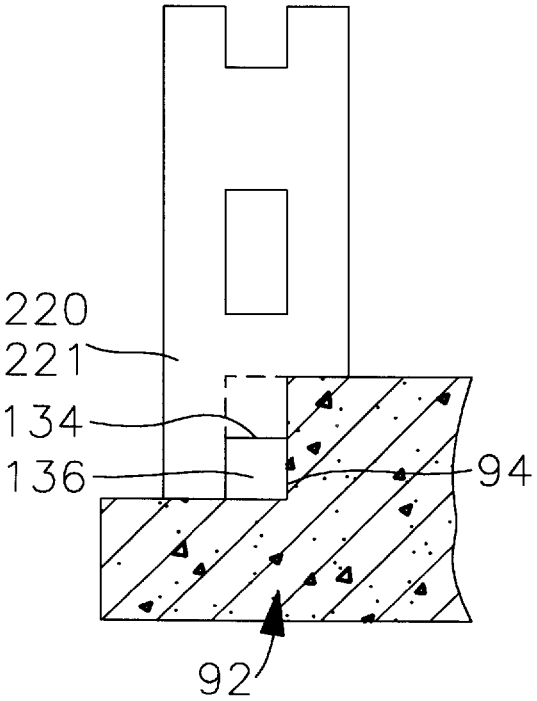
FIG. 10C is an elevation view of a partial peg support block engaging a half peg block forming the base level of a wall which interfaces with the foundation.

In an alternate embodiment, the same square house can be built using the mono-bond set of blocks which include the hybrid, double rectangular peg, and peg support blocks. To build the base level of the first wall, half hybrid and double rectangular peg blocks split along their central longitudinal axes are used. The peg support blocks 120, 121 have the lower half of one of their lower B section's "T" crossbar removed. This allows them to be positioned perpendicularly to the foundation thinner section and form a lower notch 134 with the ledge 34 (FIG. 10C).

Figure 11:
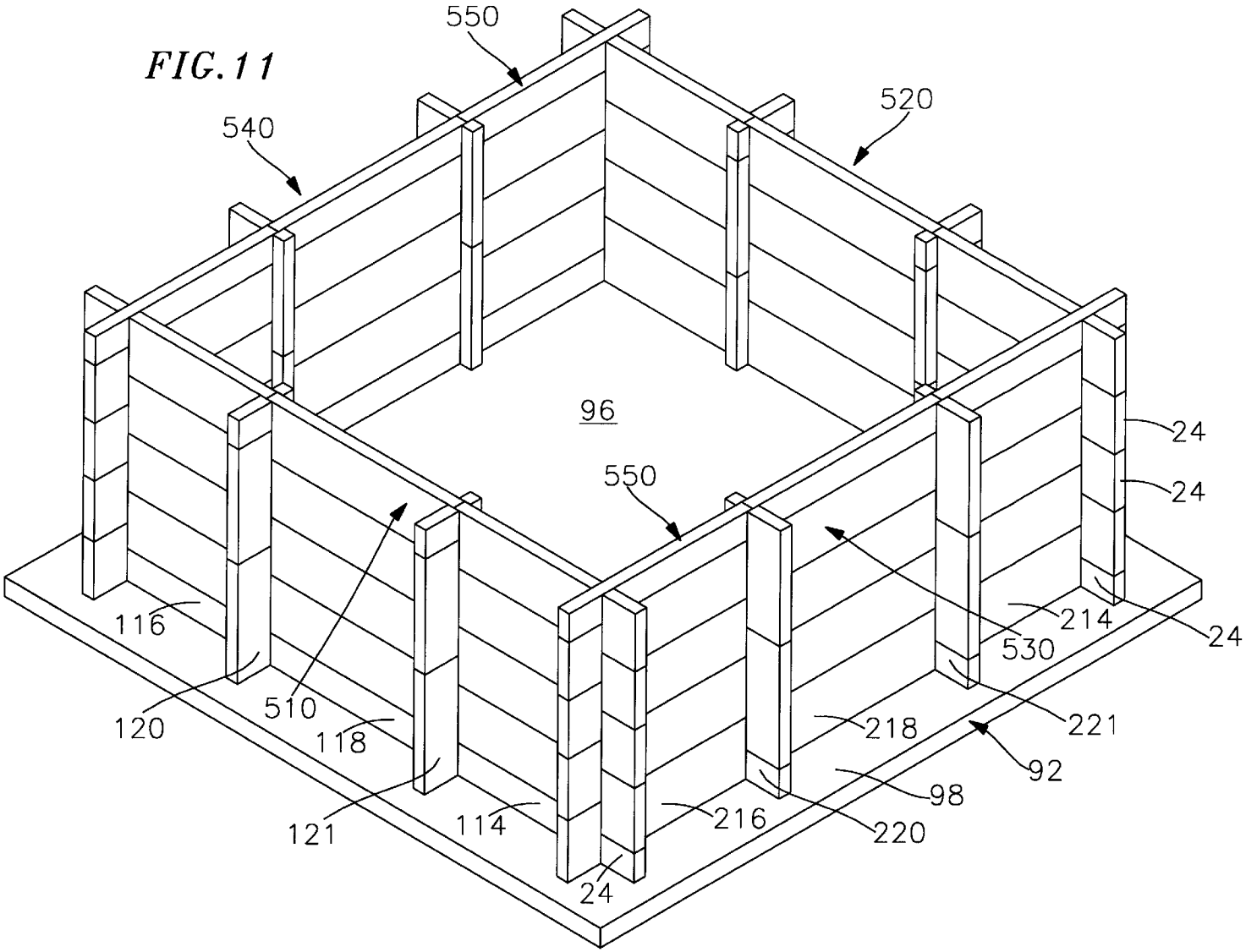
FIG. 11 is an isometric view of the walls of a square house built on a concrete foundation using the mono-bond set of blocks.

The first block of the base level of the first wall 510 is formed using a half hybrid block 116 resting heightwise against the foundation ledge with its B section protruding beyond the ledge (FIG. 11). A first peg support 120 block with its removed lower portion is positioned perpendicularly to the hybrid block and against the ledge such that the half hybrid block's peg (C section 136) penetrates the bottom notch 134 of the peg support block formed by the ledge (FIG. 10C). A half double rectangular peg block 118 is then positioned against the ledge with one of its peg's penetrating the first peg support block from the side opposite and abutting the hybrid block. A second full peg support block 121 is mated perpendicularly to the other peg of the double rectangular peg block in the same way as was the first support block 120. Finally, another half hybrid 117 is fitted with its peg penetrating and abutting the second peg support block and abutting the peg of the double peg block. The lengths of the blocks are chosen such the B section 24 of the second hybrid also protrudes beyond the ledge (FIG. 11). Note that multiple double square peg blocks of shorter length with additional support peg blocks can be also be used.

Figure 10D:
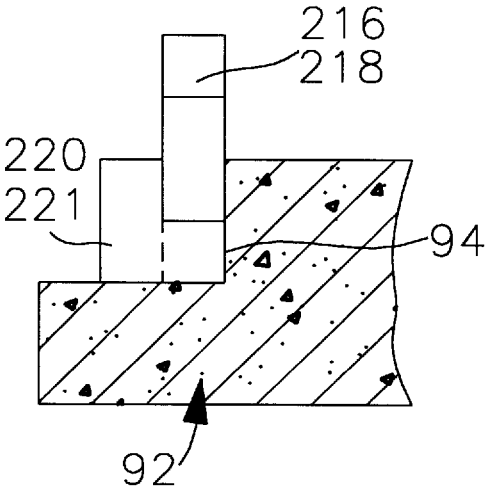
FIG. 10D is an elevation view of a partial peg support block engaging a full peg block forming the base level of a wall which interfaces the foundation.

The same procedure is followed in building the base of the second wall 520. The third wall is formed using full hybrid and double rectangular peg blocks. The peg support blocks 220, 221, however must have a portion of their lower sections removed so that they may rest flat against the foundation while providing support to the peg blocks (FIG. 10D). The protruding B sections 24 of the hybrid blocks forming the third wall interlock with the protruding B sections 24 of the hybrid blocks used in the first and second walls. This interlocking provides wall lateral support. Further support is provided by the peg support blocks. The same procedure is followed in building the fourth wall 540. The remainder levels of the walls are built using full blocks. However, as with the previous embodiment, the last level of blocks 550 forming the third and fourth walls must be split in half to maintain the same height with the first and second walls.

Figure 12:
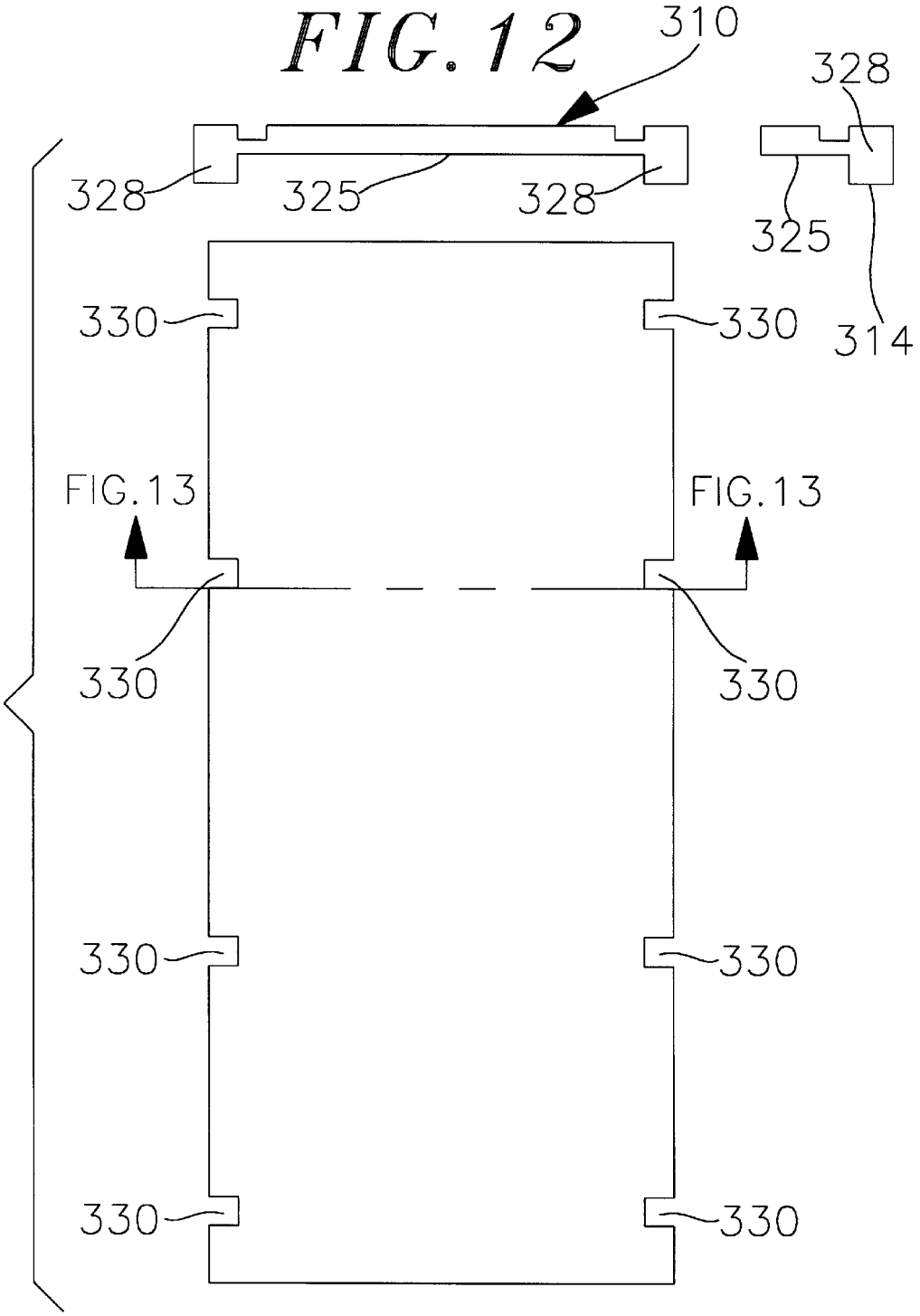
FIG. 12 is a top view of the foundation having notches and a side view of partial double lock and single lock blocks designed to engage the notched foundation.
Figure 13:
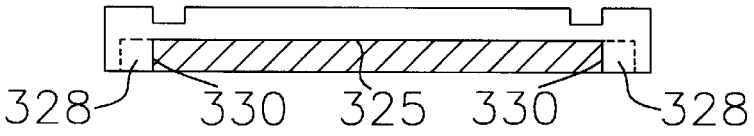
FIG. 13 is a mean view of the partial double lock block engaging the notched foundation.

A further alternate embodiment also uses mono-lock blocks. However, the foundation does not have a ledge, but rather has notches 330 around its perimeter (FIG. 12). The difference between this embodiment and the other mono-lock block embodiment is that the base of the walls are built with full and partially split double lock blocks 310 and single lock blocks 314. The split blocks have half of their lower A sections as well as half of their B sections' base legs removed. The base of these blocks are positioned with their lower edges 325 flat on the foundation with their B sections' "T" crossbars 328 engaging and interlocking with the foundation notches 330 (FIG. 13). At the same time the notches on their upper surfaces provide a basis for interlocking with the other blocks of the set.

Figure 14:
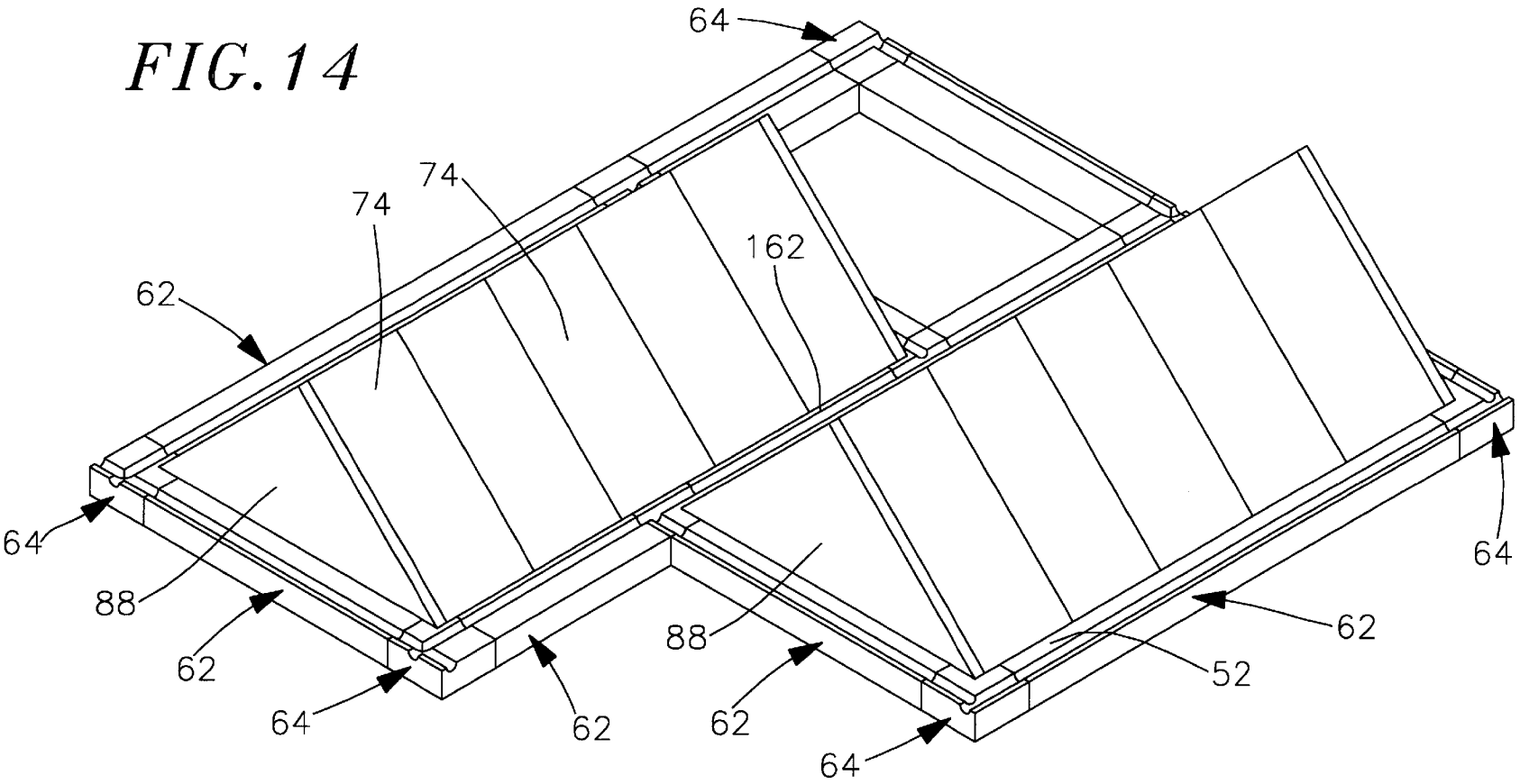
FIG. 14 is an isometric view of a double inverted V-shaped roof supported by interface plates.

The next steps with all three embodiments are selecting the use of the roof interface or interface plates and choosing the proper roof. Since each wall will be supporting a single roof, interface-2 interface plates 42 (FIG. 4) will be used. (A interface-1 type of block can also be used). The interface-2 plates engage the walls with their wall groove 55 (FIG. 5). Depending on the length of the walls, single or multiple interface-2 plates 62 may be used to span the length of each wall. When positioned on the walls, the rounded gutter groove 52 is placed external of the house wall, while the light groove is placed internal to the house walls 58 (FIG. 5). Corner interface-2 plates, 64, having grooves spanning their length, as well as, half of their width are fitted on the walls forming the corners (FIG. 14). These plates have their grooves spanning their length and at least half of their width.

Figure 8A:
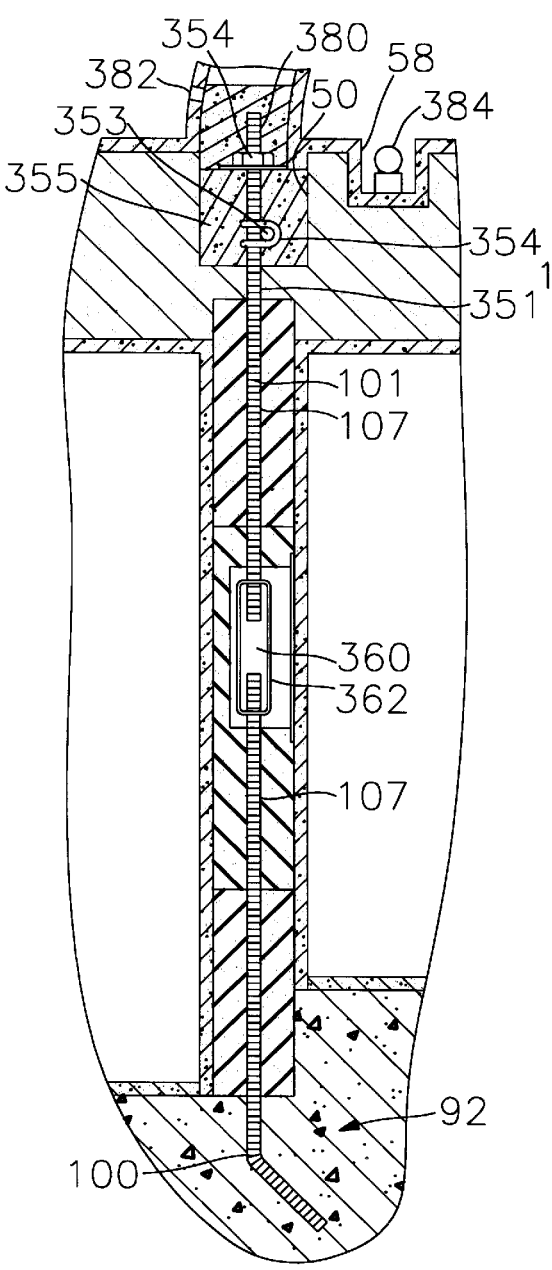
FIG. 8A depicts a cross sectional view of a wall having post tension tie downs.
Figure 8B:
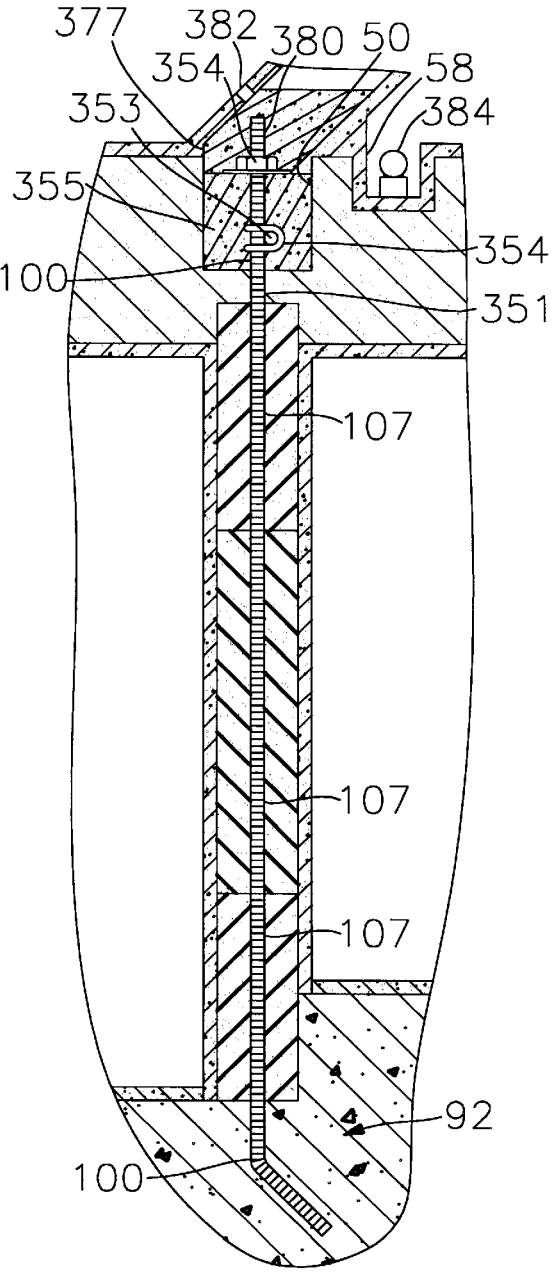
FIG. 8B depicts a cross sectional view of a wall having tie down rods.

Openings 351 are drilled vertically through the roof grooves of the interface plates to allow the threaded tie down rods to protrude through them (FIG. 8B). Once the interface plates are in place, a rebar rod 353 is routed in the lower portion of the upper roof groove 50 and is perpendicularly coupled 354 to the tie down rods. Then, the lower portion of the roof notch is filled with concrete covering the rebar and forming a concrete collar beam 355.

Once the concrete sets, nuts 354 are threaded on the protruding galvanized rods. As the nuts thread on the galvanized rods they force the interface plates against the wall blocks tying them down against the foundation.

In an alternate embodiment, two sets of galvanized threaded rods are used to form post tension tie downs. Each post tension tie down is formed using two rods, one from each set, having opposite threads. Rods 100 from the first set are built into the foundation in the same fashion as with the previous embodiment. The first set rods are shorter such that they penetrate a portion of the wall height through vertically aligned holes 107 which are drilled in the wall blocks. As described earlier, these holes span the height of the wall as well as penetrate through the interface plate roof groove. Each rod from the second set has a stop, such as a nut 354, threaded on one end. The rods 101 from the second set are installed through the wall holes in the roof groove and subsequent lower blocks. As with the previous embodiment, a rebar 353 is routed in the lower portion of the roof groove and is perpendicularly coupled to the rods proximate the stops. A concrete collar beam 355 is then formed on the lower portion of the roof groove encasing the rebar 353 and abutting the lower surface of the stops 359.

Once all rods are installed, a rod from the first set is aligned with a rod from the second set. However, the lengths of the rods are such that a gap 360 exists between each pair of aligned rods. A turnbuckle 362 having threads at each end is used to engage the free ends of each pair of threaded rods. The internal threads on one end of the turnbuckle are opposite of the internal threads on the other end. The threads on one end are matched to the threads on the first set of rods, and the threads on the other end are matched to the treads on the second set or rods. Thus, as the turnbuckle is rotated in one direction it threads on the pair of rods forcing them toward each other such that the stop on each second set rod engages the concrete collar beam in the roof groove forcing the interface plates against the wall blocks and the foundation, generating a compressive force within the blocks tying them down against the foundation.

In an alternate embodiment which does not use tie down rods, the base level wall blocks are bonded to the foundation. A further embodiment incorporates tie downs, as well as, bonding of the base level blocks to the foundation.

Next the roof is installed. For illustrative purposes, an inverted V-shaped roof will be described having two inclined sides forming the inverted V and two triangular vertical sides 88 to close the roof (FIGS. 5 and 14). The inclined sides are formed by multiple sets of angle edged blocks 74 which interlock with each other using a tongue groove type of connection. The edges of the angle edged blocks are angled so that when the groove of one block is mated with the tongue of another, the edges of the two blocks form a vertical interface 375. The angles of the edges of the blocks and the block lengths are chosen such that when the blocks are mated their opposite edges are spaced so as to engage the interface plate roof grooves 50.

The angled edged blocks are connected at one end forming the inverted V-shaped roof and are positioned to engage the roof grooves of the interface plates of the first and second walls with their other ends. To do so, the edges are cut or shaved about a vertical plane 377 (FIGS. 5 and 8B) . This allows them to slide into the vertical walled roof groove 50. The edges of the roof rest against the concrete collar beam 355 within the roof groove. Openings 380 may have to be drilled at the edges to accommodate the protruding tie down rods, if necessary.

Once the V-shaped is in position, the base edge of the triangular shaped block 80 is slid into the roof groove of the third wall interface plates. The same is done with the fourth wall. These triangular blocks can themselves be formed by multiple blocks which when abutted to together form a triangular shaped block. These blocks are mated to the inverted V-shaped roof edge surfaces 75, closing the roof, as shown in FIG. 14. If a semicylindrical roof is used, then semicircular blocks 90 instead of triangular are used, as shown in FIG. 6.

When the roof is in place, small openings 382 are drilled on the roof outer surfaces proximate the interface plates. These openings provide a path from the outer roof to the concrete collar beam within the roof groove of the interface plate. Concrete is then sprayed through those openings bonding the roof to the concrete collar beam.

Figure 16A:
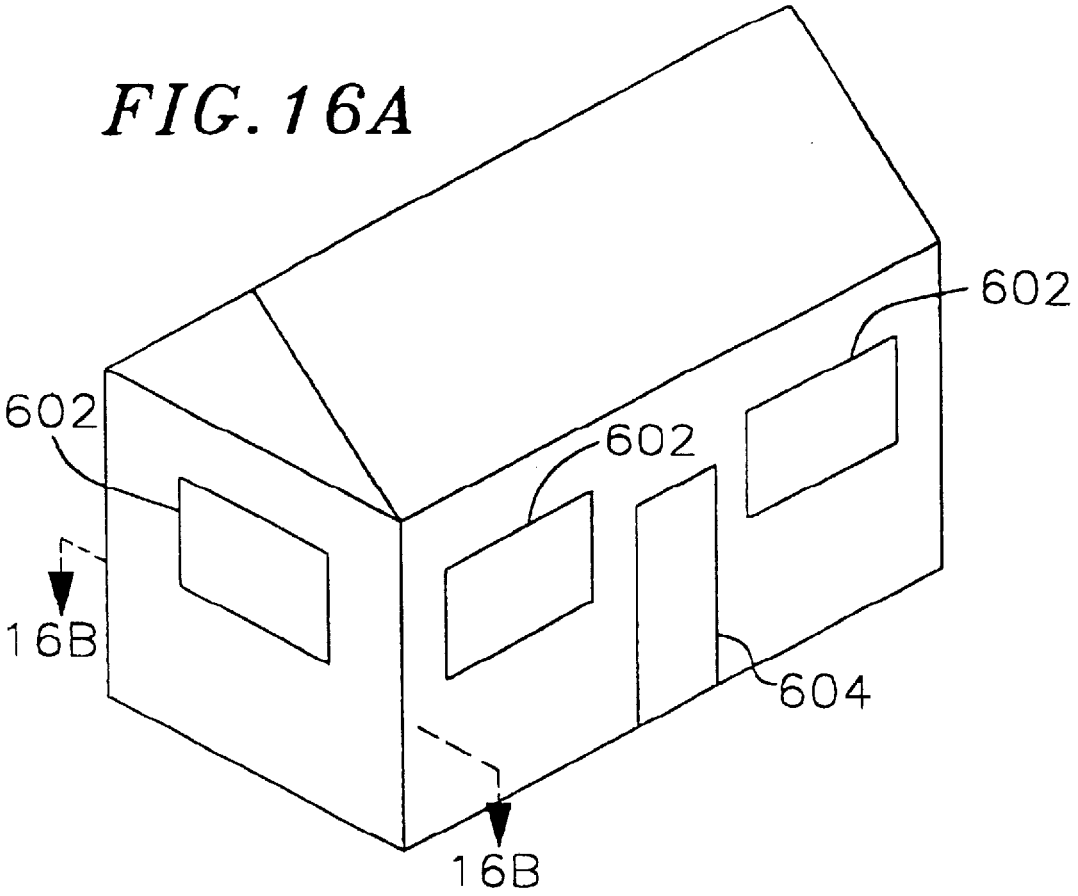
FIG. 16A is a perspective view of a house built in accordance with the embodiments of the present invention.
Figure 16B:
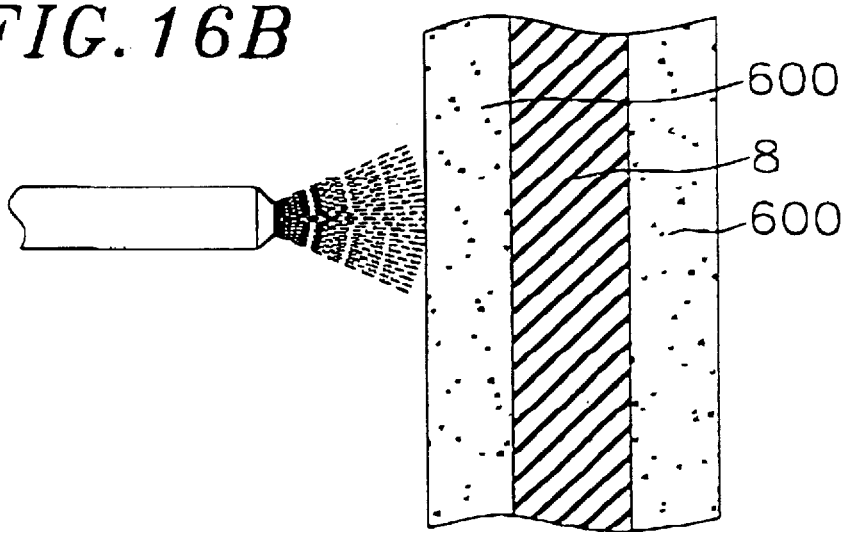
FIG. 16B is a cross-sectional view of a wall of the house depicted in FIG. 16A showing concrete being sprayed on the wall of the house formed from foam blocks.

Once the structure of the house is built using the foamed plastic blocks, windows 602 and door 604 are cut out from the foamed plastic. Electrical and plumbing hardware can now be embedded into the blocks by making cutouts in their outer surfaces. Next, the foamed plastic block structure is sprayed with concrete on its inner and outer surfaces. The horizontal surfaces proximate the walls are also sprayed forming a continuous layer with the layer sprayed on the walls (FIGS. 16A and 16B). Single or multiple layers 600 can be sprayed. It is preferable, however, to spray multiple thin layers of concrete wherein each layer is allowed to partly set prior to the application of the next layer to minimize slump. A typical thin layer has a thickness of approximately 8.0 mm. In an alternate embodiment, the concrete layers are applied using a trowel.

The sprayed concrete contains a polymer which acts as an adhesive to aid in the adhesion of the concrete against the foamed plastic blocks and also contains chopped fibers to keep the concrete coherent. The adhesive character of the polymer also helps to minimize slump.

Preferably polymer-portland cement concrete, also called polymer modified concrete, is used. This is basically normal portland cement concrete to which a polymer or monomer has been added during mixing.

The chopped fibers are added to the concrete during mixing. The fibers, can be made from steel, plastic, glass and natural (cellulose) and other materials, and are available in a variety of shapes (round, flat, crimped, and deformed) and sizes with typical lengths of 1.0–8.0 cm and thicknesses ranging from 0.005–0.75 mm. Steel fibers have been shown to significantly improve concrete flectural strength, impact strength, toughness, fatigue strength and resistance to cracking.

The aggregate in the concrete is sand without coarse gravel. Thermoplastic and elastomeric latexes can be used. Epoxies and other polymers can also used. In general, latex improves ductility, durability, adhesive properties, resistance to chlorideion ingress, shear bond, and tensible and flectural strength of concrete and mortar. Latex modified concrete (LMC) can also be used. LMC also has excellent freeze-thaw, abrasion, and impact resistance. Some LMC materials can also resist certain acids, alkalies, and organic solvents.

Once the concrete sets, a concrete monocoque structure is formed. Lighting 384 can then be added in the light grooves 58 of the interface plates (FIGS. 8A and 8B).

Note that a square house with no inner walls and a single roof was described herein only by way of example. The present technique can be used to build other shapes of houses with or without inner walls. If a house, for example, has an inner wall, two roofs can be used as shown in FIG. 14. In this situation the inner walls will be fitted with either the interface-3 or interface-4 interface plates 162 which have two roof grooves. Each groove will engage and support one end of each of the roofs with the other end being supported by the outer walls. Furthermore, flat or other shaped roofs can also be used. These roofs can be single block or multiple block formed roofs.

Only a few of the preferred embodiments have been described herein. People skilled in the art and technologies to which this invention pertains will appreciate the alternatives and changes in the described invention without meaningfully departing from the principle, spirit or scope of the invention. For example, other shapes of interlocking blocks can also be used. For instance, blocks having rounded or other shape notches, instead of rectangular notches, can also be used.

In other embodiments, some of the walls may be built using prefabricated foamed plastic panels rather than blocks. Concrete is then sprayed or otherwise applied to the panels and/or blocks. Some of these prefabricated panels may have a layer of concrete pre-applied on their outer surfaces. When using such panels only one layer of concrete may have to be sprayed or otherwise applied on their outer surfaces.

What is claimed is:

1. A concrete monocoque shell house comprising:

a concrete foundation;

a plurality of blocks, supported by the foundation, forming a structure of the house having perpendicularly interlocking walls having inner and outer surfaces; and a layer of concrete over each of the inner and outer surfaces of the structure continuing on the foundation proximate the walls of the structure, forming a double monocoque shell having inner and outer load bearing shells.

2. A concrete monocoque shell house as recited in claim 1 comprising interlocking blocks which are perpendicular to each other.

3. A concrete monocoque shell house as recited in claim 1 wherein the blocks are fabricated from foamed plastic.

4. A concrete monocoque shell house as recited in claim 3 wherein the blocks are fabricated from expanded plastic.

5. A concrete monocoque shell house as recited in claim 1 wherein the foundation comprises a stepped ledge spanning a periphery of the foundation for supporting the blocks interfacing with the foundation.

6. A concrete monocoque shell house as recited in claim 1 comprising:

a first set of blocks forming walls of the house;

a second set of blocks forming a roof of the house; and a set of plates providing a connecting interface between the walls and the roof of the house.

7. A concrete monocoque shell house as recited in claim 6 wherein the first set of blocks comprises blocks selected from the group consisting of double lock, single lock, plain, hybrid, double rectangular peg, peg support blocks and portions thereof.

8. A concrete monocoque shell house as recited in claim 6 wherein the first set of blocks comprises blocks selected from the group consisting of double lock, single lock, and plain blocks and portions thereof.

9. A concrete monocoque shell house as recited in claim 6 wherein the first set of blocks comprises blocks selected from the group consisting of hybrid, double rectangular peg and peg support blocks and portions thereof.

10. A concrete monocoque shell house as recited in claim 6 wherein the second set of blocks comprise blocks selected from the group consisting of angle edged blocks, triangular blocks, curved rectangular blocks and semicircular blocks.

11. A concrete monocoque shell house as recited in claim 6 wherein the set of plates comprise interface plates selected from the group consisting of linear and corner interface-1, interface-2, interface-3 and interface-4 plates.

12. A concrete monocoque shell house as recited in claim 1 further comprising means for attaching to the foundation the blocks interfacing with the foundation.

13. A concrete monocoque shell house as recited in claim 1 further comprising means for tying down the blocks for forming the walls against the foundation.

14. A concrete monocoque shell house as recited in claim 13 wherein the means for tying down the blocks comprise a plurality of two rod post tension tie downs wherein each tie down comprises:

a first rod having outer threads, wherein the rod is fabricated into the foundation and protrudes upward penetrating heightwise through the blocks which form the walls;

a second rod having outer threads opposite those of the first rod and having a stop, wherein the second rod is vertically aligned to the first rod and penetrates downward and heightwise through an interface plate and the blocks which form the walls; and a turnbuckle having first and second internally threaded ends, wherein the turnbuckle first end has internal threads mated to the outer threads of the first rod, wherein the turnbuckle second end has internal threads opposite the internal threads of the first end wherein the second end internal threads are mated to the outer threads of the second rod wherein when turned the turnbuckle draws the two rods toward each other forcing the stop against the interface plate generating a compressive force on the blocks penetrated by the rods, tying them down against the foundation.

15. A concrete monocoque shell house as recited in claim 13 wherein the means of tying down the rods comprise:

threaded rod tie downs built into the foundation, protruding upward and heightwise through the blocks which form the walls; and nuts threaded at on the rod ends protruding through the blocks wherein as the nuts are threaded farther on the rods, the nuts exert a force on the blocks forming the walls, tying down the blocks against the foundation.

16. A concrete monocoque shell house comprising:

a foundation;

foamed plastic blocks forming a house structure having walls having inner and outer surfaces, wherein the blocks form the walls in levels and wherein a level of each wall interlocks with a level of an adjacent wall; and a layer of concrete over the inner and outer surfaces of the foamed plastic block formed structure and on the foundation proximate the walls of the structure forming a concrete double monocoque shell house having inner and outer load bearing shells.

17. A concrete monocoque shell house as recited in claim 16, wherein the walls of the house are formed using blocks selected from the group consisting of double lock, single lock, plain, hybrid, double rectangular peg, peg support blocks and portions thereof, wherein a roof of the house structure is formed using blocks selected from the group consisting of angle edge blocks, triangular blocks, curved rectangular plates and semicircular plates, and wherein the roof interfaces with the walls using plates selected from the group consisting of linear and corner interface-1, interface-2, interface-3, and interface-4 plates.

18. A method for forming a monocoque concrete shell house comprising the steps of:

forming a concrete foundation;

building a house structure having internal and external surfaces on a foundation using a plurality of foam blocks; and applying a layer of concrete covering the house structure internal and external surfaces and a portion of the foundation proximate the blocks which interface with the foundation, forming a concrete double-wall monocoque shell house structure having inner and outer load bearing shells.

19. A method for forming a concrete monocoque shell house as recited in claim 18 wherein the step of building a house structure comprises using foamed plastic perpendicularly interlocking blocks.

20. A method for forming a concrete monocoque shell house as recited in claim 18 wherein the step of building a house structure comprises using interlocking foam blocks perpendicular to each other.

21. A method for forming a monocoque shell house as recited in claim 18, wherein the step of forming a concrete foundation further comprises the step of forming a stepped ledge on the foundation defining an outer plan shape for the house.

22. A method for forming a monocoque concrete shell house as recited in claim 18 further comprising the step of attaching some of the blocks to the foundation.

23. A method for forming a monocoque shell house as recited in claim 18, further comprising the step of building a wall a level at a time in sequence with other walls for forming the house structure, wherein a level of each non-adjacent wall is built first.

24. A method for forming a monocoque concrete shell house as recited in claim 18 further comprising the step of tying down the foamed plastic blocks on the foundation.

25. A method for forming a monocoque concrete shell house comprising the steps of:

forming a concrete foundation having a ledge defining an outer plan shape of the house;

building walls of the house using interlocking and non-interlocking foamed plastic blocks selected from the set of blocks consisting of double lock, single lock, plain, hybrid, double rectangular peg, and peg support blocks, wherein each wall interlocks with an adjacent wall, wherein blocks interfacing with the foundation are set longitudinally and heightwise against the ledge, wherein each block forming the length of the base of a nonadjacent wall is cut along a central longitudinal axis removing a lower portion of the block, and wherein each block forming a length of a top row of a wall adjacent to a wall having the cut base forming blocks, is cut along a longitudinal axis removing a lower portion of the block, and wherein some blocks are cut to allow for flush interfacing with other blocks or the ledge;

building the roof of the house by tongue and groove interconnecting foamed plastic roof blocks selected from the group consisting of angled edged blocks, triangular blocks, curved rectangular and semicircular blocks to form inverted V-shaped roofs or semicylindrical roofs;

interfacing the roof to the walls using foamed plastic interface plates having roof grooves to engage and interlock with the roof and wall grooves to engage and interlock with the walls;

forming windows and doors by cutting openings through the walls;

embedding electrical and plumbing hardware into the foamed plastic blocks; and applying a layer of concrete on inner and outer surfaces of the walls as well as on a portion of the foundation adjacent to the inner and outer surfaces of the walls forming a monocoque concrete shell structure.

26. A method for forming a monocoque concrete shell house as recited in claim 25, wherein the step of interfacing the roof to the walls comprises using blocks selected from the group consisting of corner and linear interface-1, interface-2, interface-3 and interface-4 blocks.

27. A method for forming a monocoque concrete shell house as recited in claim 25 wherein the step of applying the layer of concrete comprises the step of spraying the layer of concrete.

28. A method for forming a monocoque concrete shell house as recited in claim 25 further comprising the step of attaching to the foundation blocks interfacing with the foundation.

29. A method for forming a monocoque concrete shell house as recited in claim 25 further comprising the step of tying down against the foundation the interface plates and the blocks forming the walls.

30. A method for forming a monocoque shell house as recited in claim 29 wherein the step of tying down further comprises the steps of:

installing tie down threaded rods on the foundation proximate the ledge;

drilling openings heightwise through thickness of the blocks forming the walls and vertically through the roof grooves of the interface plates to allow the tie down rods to penetrate and protrude through the blocks; and tying down the interface plates and the blocks forming the walls by threading a nut on an end of the tie down rod protruding through the roof grooves of the interface plates.

31. A method for forming a monocoque concrete shell house as recited in claim 30 wherein the step of installing tie down threaded rods comprises:

installing a first set of rods having threads on the foundation;

installing a second set of threaded rods having a stop threaded on one end of each second set rod through drilled openings in the interface plates and the blocks forming the walls so that the stops rest against the interface plates, wherein the second set of threaded rods have threads that are opposite of the threads on the first set of rods and wherein the rods from the first set are aligned with the rods from the second set;

connecting the the first and second sets of rods within the blocks which form the walls using tumbuckles, wherein as a turnbuckle is turned the turnbuckle draws the rods together tying down the blocks against the foundation.

32. A method for forming a monocoque shell house as recited in claim 25 wherein the step of interfacing the roof to the walls further comprises the steps of:

placing a rebar through a lower portion of the roof notch; and forming a concrete collar beam surrounding the rebar on the lower portion of the roof notch by pouring concrete into the groove prior to engagement with the roof; and engaging the roof and interlocking the roof with the roof groove.

33. A method for forming a monocoque shell house as recited in claim 32 further comprising the steps of:

drilling openings on a roof outer surface proximate the roof groove of the interface plates, exposing the concrete collar beam; and pouring concrete through the openings to bond the roof to the concrete collar beam and interface plates.

34. A concrete monocoque shell house comprising:

a concrete foundation;

a layer of expanded plastic foam having inner and outer surfaces defining at least walls and a roof for the house;

a continuous layer of concrete over each of the inner and outer surfaces of the plastic foam layer of the walls and roof and continuing onto the foundation adjacent to the walls of the house for forming a self supporting double monocoque shell having inner and outer load bearing shells.

35. A concrete monocoque shell house comprising:

a foundation;

a plurality of preformed foamed plastic blocks forming a house structure having walls and a roof having inner and outer surfaces, wherein the blocks form the walls in levels and wherein a level of each wall interlocks with a level of an adjacent wall; and a layer of concrete over each of the inner and outer surfaces of the foamed plastic blocks forming the walls and roof and on the foundation adjacent to the walls of the structure for forming a self supporting concrete double monocoque shell having inner and outer load bearing shells.

36. A method for forming a monocoque concrete shell house comprising the steps of:

forming a concrete foundation;

erecting a house form on a foundation using a plurality of foam plastic blocks selected from a suite of plastic blocks which interlock with each other in perpendicular directions; and applying a layer of concrete covering the house form inner and outer surfaces and a portion of the foundation adjacent to the blocks, each layer of concrete interfacing with the foundation for forming a self supporting concrete monocoque shell house structure.

37. A concrete monocoque shell house comprising:

a concrete foundation;

a plurality of blocks supported by the foundation, forming a surface for the house having inner and outer surfaces; and a layer of concrete over each of the inner and outer surfaces of the house structure continuing on the foundation, forming a double monocoque shell having inner and outer load bearing shells.

38. A concrete monocoque shell house as recited in claim 37 wherein the blocks are fabricated from foam plastic.

* * * * *